United States Patent [19]

Leath

[11] Patent Number: 5,004,136

[45] Date of Patent: Apr. 2, 1991

[54] JANITORIAL UTILITY BELT FOR CARRYING SPRAY BOTTLES, GLOVES, DUSTERS, AND CLEANING TOWELS

[76] Inventor: Robert P. Leath, 405 Foxpark Dr., Pomona, Calif. 91767

[21] Appl. No.: 299,932

[22] Filed: Jan. 23, 1989

[51] Int. Cl.[5] ..... A45F 5/00

[52] U.S. Cl. ..... 224/253; 224/226; 224/268; 224/901; 224/904

[58] Field of Search ..... 224/224, 240, 226, 211, 224/215, 216, 252, 253, 269, 268, 904, 901

[56] References Cited

U.S. PATENT DOCUMENTS

| | | | |
|---|---|---|---|
| 1,600,027 | 9/1926 | Welsand | 224/904 |
| 3,361,312 | 1/1968 | Hutchison | 224/240 |
| 3,664,560 | 5/1972 | Perkins | 224/901 |
| 4,747,527 | 5/1988 | Trumpower, II | 224/224 |
| 4,867,360 | 9/1989 | Howard | 224/148 |

FOREIGN PATENT DOCUMENTS

| | | | |
|---|---|---|---|
| 975535 | 3/1951 | France | 224/252 |

*Primary Examiner*—Linda J. Sholl

*Attorney, Agent, or Firm*—Boniard I. Brown

[57] ABSTRACT

A janitorial utility belt for encircling a person's waist, has a plurality of web elements attached to and spaced along the belt and extending downwardly and then upwardly to connect with the belt to form loops, a plurality of rings each extending through respective loops, at least one pouch for receiving a liquid containment bottle, at least one strap for each pouch with one end attached to the pouch upper end and extending upwardly through one of the connector rings, then downwardly to the pouch, each strap having first and second facing surfaces with fibrous loops on one of the surfaces and fibrous hooks on the other surface to interlock and detachably secure the facing surfaces together.

7 Claims, 1 Drawing Sheet

JANITORIAL UTILITY BELT FOR CARRYING SPRAY BOTTLES, GLOVES, DUSTERS, AND CLEANING TOWELS

BACKGROUND AND SUMMARY OF THE INVENTION

The present invention relates to janitorial utility belts for carrying cleaning items such as spray bottles, gloves, dusters and cleaning towels, thus to facilitate the efficient cleaning of commercial industrial and residential buildings. Persons engaged in cleaning and servicing building interiors, offices, and various interior and exterior facilities, have long employed various devices and arrangements for carrying cleaning implements, equipment and supplies to and from the areas to be cleaned or serviced and during cleaning and servicing. Heretofore, a variety of such devices have been proposed. One such device is a maid's caddy that comprises a plastic or aluminum box having a carrying handle. Such a box is not very satisfactory because it does not allow the user to have his/her hands free. Also, the person must repeatedly pick up and put down the box whenever he/she moves to a different location.

Another cleaning implement carrier device is a caddy bag designed to be strapped onto a janitor cart, the bag having large pockets for holding cleaning supplies and implements. However, the janitor cart cannot be moved into small clearance areas. Accordingly, in some instances the person must leave the cart behind, in which case he/she has to make repeated trips back to the cart in order to effectively use the tools and implement supplies.

The present invention relates to carrier apparatus for janitorial tools and supplies, wherein the tools and supplies are readily available, even when the person is required to work in small clearance spaces. The carrier mechanism is designed to hold implements and supplies in suspended positions from a specially designed belt worn by the person, such that the tools and supplies are readily available, and the person has free use of his/her hands, while the tools and supplies are disposed in an orderly and organized arrangement. Items used in janitorial operations are disposed in specific locations on the person's belt. The person thus is able to quickly select any given item when needed, thereby enabling the work to be performed more expeditiously.

DESCRIPTION OF A PREFERRED EMBODIMENT OF THE INVENTION

Figure 1:
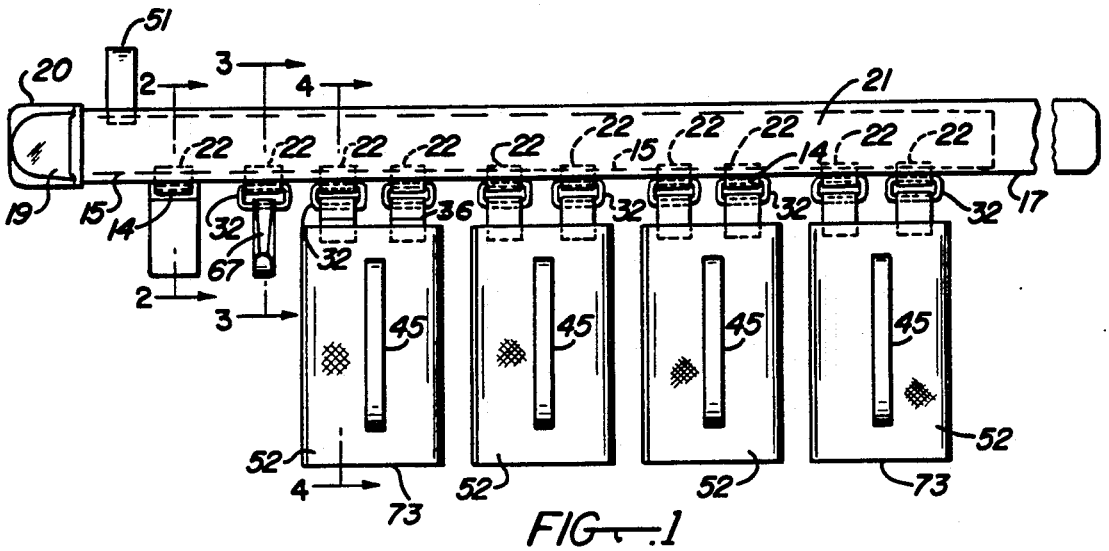
FIG. 1 is a front elevational view of a janitorial utility belt embodying the invention.
Figure 2:
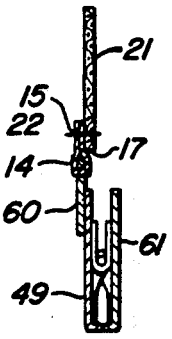
FIG. 2 is an enlarged sectional view taken on line 2—2 in FIG. 1.

FIG. 1 shows an elongated belt 21 which may preferably be formed of a polyester webbing material. The belt has a preferred vertical width dimension of about two inches, and its length will vary, in accordance with the waist size of the person wearing the belt. The length of a "small" size belt could be on the order of sixty-two inches, a "medium" size belt could be about sixty-six inches long, a "large" size belt could be about seventy inches long, and an "extra large" size belt could be about seventy-six inches long. At one end, as viewed in FIG. 1, belt 21 is attached to a buckle 20, preferably formed of plastic. The buckle includes a clamping lever 19 adapted to be manually pressed toward the wearer's waist to exert a clamping force on the portion of belt 21 extending through the buckle.

A plurality of similarly constructed flexible web elements 22 are attached to the belt 21 near its lower edge 17. Each web element has a loop configuration, and may preferably be formed of polyester webbing material having width of about one inch and a length of about three and one-half inches. Each of the web elements has flat spaced areas in facial engagement with a face of belt 21.

A continuous stitching 15 extends through the engaged areas of the belt and the web elements 22, so that each web element is affixed to the belt. As seen in FIG. 1, stitching 15 extends continuously along the lower edge of the belt so that one row of stitching suffices for all of the various web elements. The stitching is spaced from the lower edge of belt 21 by about one quarter inch.

Figure 4:
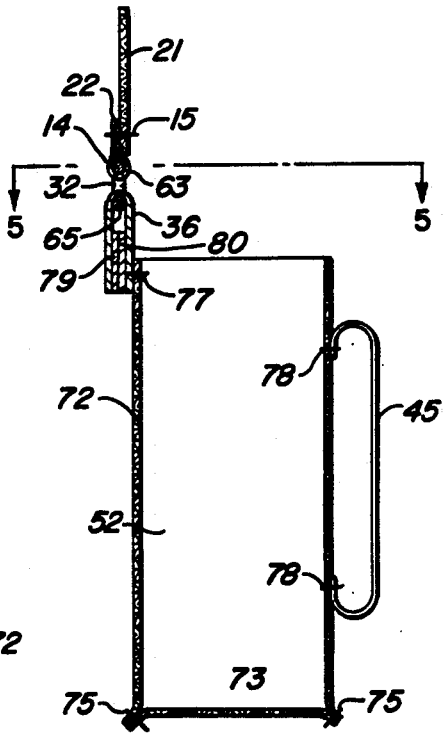
FIG. 4 is an enlarged sectional view taken on line 4—4 in FIG. 1.

As seen in FIG. 4, a representative web element 22 extends downwardly beyond the lower edge of belt 21, then upwardly back to the stitched connection with the belt, thereby forming a loop, designated generally by numeral 14.

The leftmost web element 22 serves as a suspension device for a glove gripper mechanism 49, which includes a mounting plate 60 having a slot near its upper edge adapted to receive therethrough a loop 14. A pair of pivotably connected glove-gripper jaws 61 is mounted on the front face of plate 60. These jaws are manually openable in the manner of conventional clothes pins. In the closed position of the jaws, the jaw faces at the lower ends of the jaws are enabled to grip a pair of plastic work gloves (not shown.)

Figure 3:
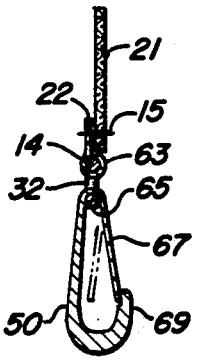
FIG. 3 is an enlarged sectional view taken on line 3—3 in FIG. 1.

FIG. 3 shows a hook structure 50 suspended from an endless D-ring connector 32, which may preferably be formed of plastic material. The ring is elongated in the horizontal direction to form two vertically spaced suspension bars of portions 63 and 65. The upper susupension portion 63 extends transversely through loop 14 of the associated web element 22. The lower suspension bar 65 is affixed to the upper end of hook structure 50. The hook structure includes a flat spring arm 67 which is manually deflectable to a dashed line position (FIG. 3) to permit the looped end of a duster handle (not shown) to be placed onto the hooked end 69 of the hook structure. The duster will hang downwardly from the hook structure in a readily accessible position.

There are eight additional connector rings 32, similar to the ring associated with hook structure 50. Each connector ring 32 has an upper suspension bar 63 extending transversely through the loop portion 14 of an associated web element 22. The lower suspension bar 65 of each of the eight connector rings 32 is adapted to receive thereabout a flexible strap 36. The straps are arranged in pairs, so that each pair of straps serves to suspend a pouch 52.

Figure 5:
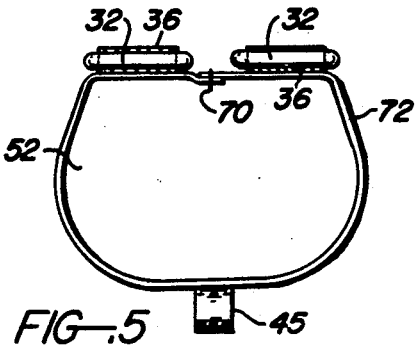
FIG. 5 is a sectional view taken on line 5—5 in FIG. 4.

Each pouch 52 comprises a length of material formed into a tubular configuration 72, as shown generally in FIG. 5. Vertical end edges of the tube materials are stitched together, as at 70 in FIG. 5, to form a tube. The upper end of the pouch tube is open, and the lower end is closed by means of a circular bottom disk 73. The adjoining corner edges of the tube and disk are stitched together, as at 75 (FIG. 4). The material for tube 72 and bottom disk 73 may be pack cloth. In a typical construction, the diameter across the formed tube would be about five and one half inches. The tube length in the vertical direction would be about ten inches. A pouch formed to such dimensions is capable of holding therewithin a spray bottle containing cleaning liquids, etc., used in the janitorial operations.

A vertically-extending strip 45 is affixed to the outer surface of each pouch 52. Each strip 45 may be polyster webbing material having a width of about one half inch and a length of about five inches. The upper and lower ends of each strip 45 are attached to the pouch side wall, as by stitches 73 (FIG. 4). The intervening portion of each strip is detached from the pouch to form a loop structure adapted to receive therethrough a cleaning towel (not shown).

It is contemplated that the cleaning towel associated with each given pouch 52 will be used to wipe surfaces that were sprayed from the associated spray bottle in that pouch. The user will thus be able to arrange the towels in an orderly fashion, knowing that each towel will be impregnated with only one designated spray liquid.

Each pouch 52 has two similarly constructed straps 36 attached thereto. As shown in FIG. 4, a representative strap 36 extends upwardly from the pouch, about an associated suspension bar position 65 on the respective connector ring 32, and then downwardly back to the pouch. The strap is connected at one of its ends to the pouch by stitching 77, and the other end of the strap is free.

Fibrous hook and loop materials marketed under the tradename VELCRO are used to detachably connect the lower facing end surfaces of each strap 36. As shown in FIG. 4, a small pad 79 containing a large multiplicity of miniature fibrous hooks is carried on one of the facing surfaces of strap 36. A second pad 80 containing a large multiplicity of miniature fibrous loops is carried on the other facing surface. When the two pads 79 and 80 are pressed together, they form a detachable adherent connection between the ends of strap 36.

Each connector ring 32 is preferably constructed so that its upper suspension bar 63 has a swivel fit in the associated web element loop 14. With such a construction, the pouches 52 are suspended from belt 21 in pendulum fashion. If the person should bend over at the waist, the various spray bottles will remain in their associated pouches, and each spray bottle will remain essentially upright so that the liquid contents do not leak out of the bottle.

For storage purposes, the janitorial belt structure may be provided with a loop structure 51, which is attached to belt 21 near buckle 20 for hanging the belt structure on a stationary hook (not shown). The spray bottles can remain in the various pouches 52 without danger that liquids will spill from the bottles. Loop structure 51 has a configuration similar to the loop configuration of each web element 22, except that its loop is somewhat larger to fit about the associated hook structure (not shown). Stitching may be used to attach the ends of loop structure 51 to belt 21.

Thus there has been shown and described a janitorial utility belt which fulfills all the objects and advantages sought therefor. Many changes, modifications variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

I claim:

1. A janitorial utility belt comprising;

a belt adapted to encircle a user's waist, said belt having an upper edge and a lower edge, a plurality of flat web elements attached to said belt at spaced points therealong, each web element extending downwardly beyond the lower edge of the belt and then upwardly to a fixed connection with the belt to form a loop, a plurality of rigid connector rings, each ring comprising two vertically spaced suspension portions, each ring having its upper suspension portion extending transversely through one of said loops for attachment of said ring to the belt, at least one hollow pouch adapted to receive therein a liquid-containment bottle and having an open upper end, flexible strap means associated with each pouch, said strap means having lower end portions thereof attached to the associated pouch at the pouch upper end, said strap means being adapted to extend upwardly from the associated pouch, about a lower suspension portion on the associated connector rings, and then downwardly toward the pouch, said strap means having first and second facing surfaces thereof located below the associated ring, fibrous loop means extending along one of said facing surfaces, and fibrous hook means extending along the other facing surface, the two fibrous means being adapted to interlock and thereby detachably adhere the two facing surfaces together.

2. A janitorial utility belt according to claim 1 wherein:

there are two rigid rings and two straps associated with each pouch.

3. A janitorial utility belt according to claim 1, and further comprising:

a vertically extending strip having upper and lower ends thereof attached to an outer side surface of each pouch, whereby the intervening portion of the strip is detached from the pouch to retain a towel in near proximity to the associated pouch.

4. A janitorial utility belt according to claim 1, wherein:

each flat web element has opposite end areas thereof in facial engagement with a face area of the belt, and further including stitching extending through the belt and facially engaged areas of each web element to attach each said web element to the belt.

5. A janitorial utility belt according to claim 4, wherein:

continuous stitching extends along the belt near its lower edge, whereby a multiplicity of web elements are attached to the belt by the continuous stitch.

6. A janitorial utility belt according to claim 1, wherein: each rigid ring is so constructed that its upper suspension bar is in swivelling engagement with the associated web element loop.

7. A janitorial utility belt comprising:

a belt forming a waist encircling member having a buckle at an end of said belt;

said buckle providing means for attaching said belt around the waist of the user;

said belt having a lower edge and an upper edge;

a plurality of polyester webbing loops attached to said lower edge;

a glove gripper, a duster hook; and a plurality of D-rings secured within said polyester webbing loops;

a plurality of elongated pouches;

each pouch having top opening shaped to allow placement of bottles inside the pouch, two straps attached at the top opening of each pouch, each strap provided with male and female loop and hook fasteners such that each strap will overlap upon itself at the male and female fasteners to form a loop;

each pouch further including a polyester webbing strip secured at its two ends on a front portion of the pouch for retaining a towel;

whereby said pouches are retained on said belt by placement of said two straps throught two of said plurality of D-rings and the two straps being overlapped upon themselves such that the male and female loop and hook fasteners are secured together.

* * * * *